United States Patent [19]

Putnal

[11] 3,956,893

[45] May 18, 1976

[54] HYDRAULIC POWER TRANSMISSION

[76] Inventor: Clifford E. Putnal, 3428 Ave. S, Galveston, Tex. 77550

[22] Filed: Dec. 23, 1974

[21] Appl. No.: 535,679

[52] U.S. Cl. ..... 60/464; 60/477; 60/484; 60/486

[51] Int. Cl.[2] ..... F15B 15/18

[58] Field of Search ..... 60/369, 374, 375, 475, 60/477, 478, 484, 486, 464, 468, 494

[56] References Cited

UNITED STATES PATENTS

| | | | |
|---|---|---|---|
| 222,554 | 12/1879 | Watson | 60/486 X |
| 1,099,472 | 6/1914 | Sundh | 60/484 |
| 3,359,727 | 12/1967 | Hann et al. | 60/464 X |
| 3,366,016 | 1/1968 | Anderson | 91/438 |

*Primary Examiner*—Edgar W. Geoghegan
*Attorney, Agent, or Firm*—Clarence A. O'Brien; Harvey B. Jacobson

[57] ABSTRACT

Power is transmitted between reciprocating crank drives by piston, pump and motor assemblies of the single-acting type interconnected in an open fluid circuit. A valve arrangement in the fluid circuit maintains the pump assembly and the pressure conduits interconnecting the assemblies completely filled with fluid during the return strokes of the pump and motor assemblies.

14 Claims, 7 Drawing Figures

22
20
26
28
30
32
34
34'
38
38'
40
40'
42
42'
44
44'
46
46'
48
50
50'
52
52'
54
54'
56
56'
58
62
70
72
74
78
80
82
84
86
88
90
92

HYDRAULIC POWER TRANSMISSION

This invention relates to the transmission of mechanical power and more particularly to a fluid pressure piston type of power transmission through which power is transmitted at a torque multiplying ratio.

Fluid pump-motor units through which mechanical power is transmitted are well known as disclosed for example in U.S. Pat. Nos. 3,512,072 and 2,706,255 to Karazija and Breaux, respectively. Such prior hydraulic power transmission systems are of relatively limited capacity, often operationally restricted by the quantity of hydraulic fluid capable of being recirculated and often plagued with operational difficulties resulting from the loss of hydraulic fluid. It is therefore an important object of the present invention to provide a hydraulic power transmission of the pump-motor type that has a theoretically higher power transmitting capacity than that associated with prior art arrangements as well as avoiding the aforementioned drawbacks associated with prior art transmission arrangements.

In accordance with the present invention, mechanical power is transmitted between two reciprocating mechanical drive assemblies such as rotating crank arrangements by single-acting piston types of pump and motor assemblies interconnected in an open fluid circuit with which a re-fillable reservoir tank is associated. The reservoir tank is mounted on a fluid pressure-tight housing enclosing a plurality of cylinders of the pump assembly. Reciprocating pistons are slidably mounted within the cylinders and connected by connecting rods to the input reciprocating drive assembly whereby the pistons are displaced through alternate pressure and return strokes. During the pressure strokes, the pistons displace fluid under pressure to the motor assembly through associated outlet check valves while during the return strokes, fluid is drawn into the cylinders through inlet check valves from the body of fluid completely filling the housing enclosing the cylinders of the pump assembly. Fluid pressure chambers on one side of the pistons associated with the motor assembly are accordingly displaced during the power strokes of the pump pistons, the pressurized fluid being delivered to these pressure chambers through pressure conduits connected to the motor piston chambers through pressure-responsive valves that are closed during the return strokes of the pistons so as to trap fluid completely filling the pressure conduits. During the return strokes of the motor pistons, fluid is displaced from the pressure chambers of the motor assembly and returned through exhaust lines to the reservoir mounted on the pump assembly housing. The piston rods associated with the motor assembly are connected to an output reciprocating crank assembly and undergo power and return strokes substantially shorter than the piston strokes associated with the pump assembly resulting in a corresponding torque multiplication. The power transmitting capacity of the foregoing system may be increased as desired by increasing the number of piston and cylinder units associated with the pump and motor assemblies. In view of the open circuit arrangement of the conduits interconnecting the pump and motor assemblies, any loss of fluid through leakage will not adversely affect the transmission of power.

These together with other objects and advantages which will become subsequently apparent reside in the details of construction and operation as more fully hereinafter described and claimed, reference being had to the accompanying drawings forming a part hereof, wherein like numerals refer to like parts throughout.

FIG. 1 is a top plan view of a typical power transmission system constructed in accordance with the present invention.

FIG. 2*a* is an enlarged partial sectional view taken substantially through a plane indicated by section line 2*a*—2*a* in FIG. 1.

FIG. 2*b* is an enlarged partial sectional view taken substantially through a plane indicated by section line 2*b*—2*b* in FIG. 1.

FIG. 3*a* is a top sectional view taken substantially through a plane indicated by section line 3*a*—3*a* in FIG. 2*a*.

FIG. 3*b* is a top sectional view taken substantially through a plane indicated by section line 3*b*—3*b* in FIG. 2*b*.

Figure 1:
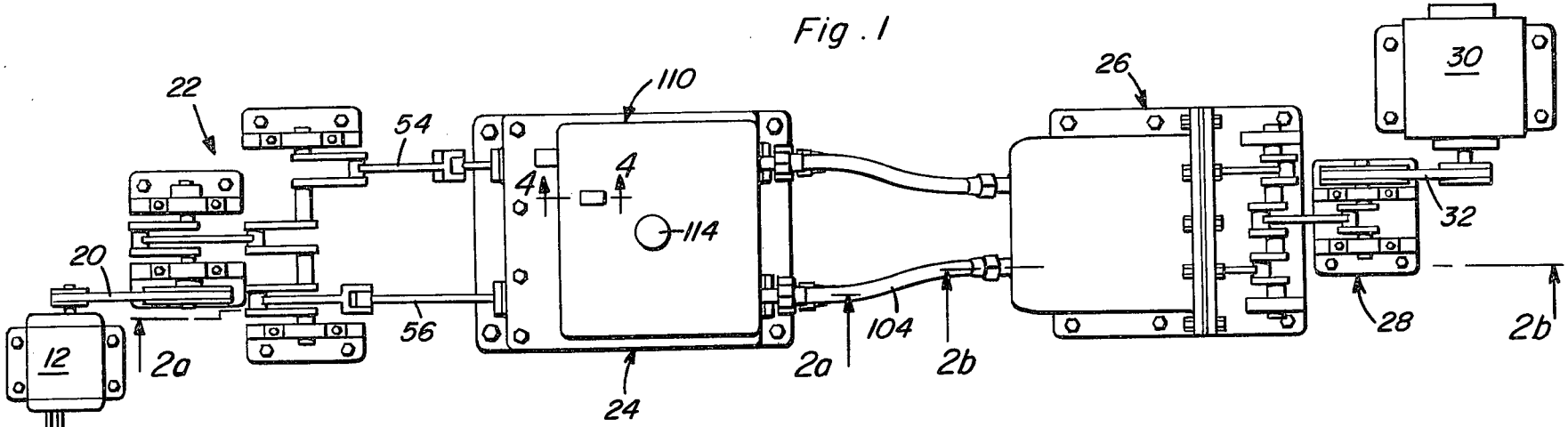

Referring now to the drawings in detail, FIG. 1 illustrates the power transmission system of the present invention generally referred to by reference numeral 10. By way of example, power is transmitted from a prime mover such as an electric drive motor 12 connected to a battery source of electrical energy 14 under control of an on-off switch 16. The drive motor 12 is drivingly connected by an endless drive belt 18 to a reciprocating crankshaft drive assembly generally referred to by reference numeral 22. The reciprocating drive assembly 22 is operative to impart reciprocating movement to a pump assembly generally referred to by reference numeral 24 which is hydraulically interconnected with a fluid motor assembly generally referred to by reference numeral 26. The motor assembly 26 is mechanically connected to a second reciprocating drive assembly 28 on the output side of the power transmission system 10 in order to drive an alternator-generator 30 by way of example through an endless drive belt 32.

Figure 2A:
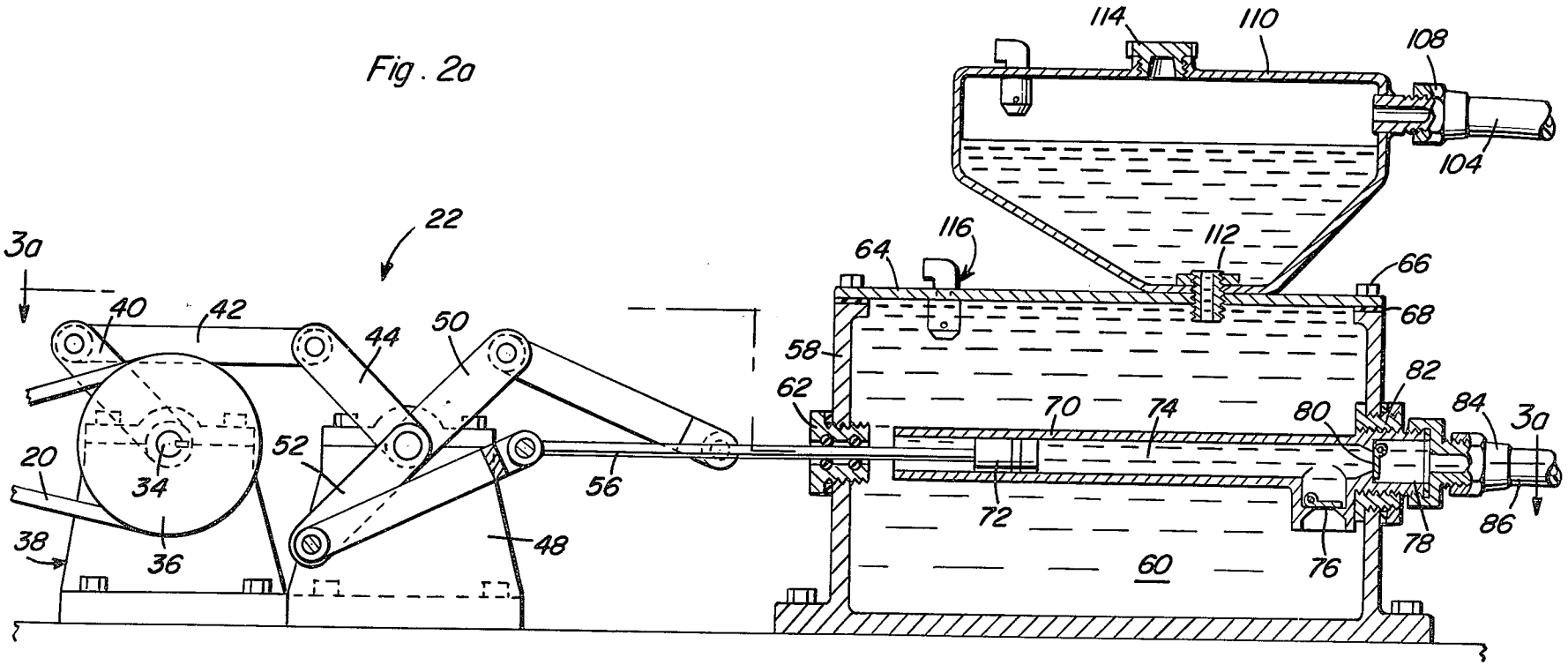
Figures 3A, 3B:
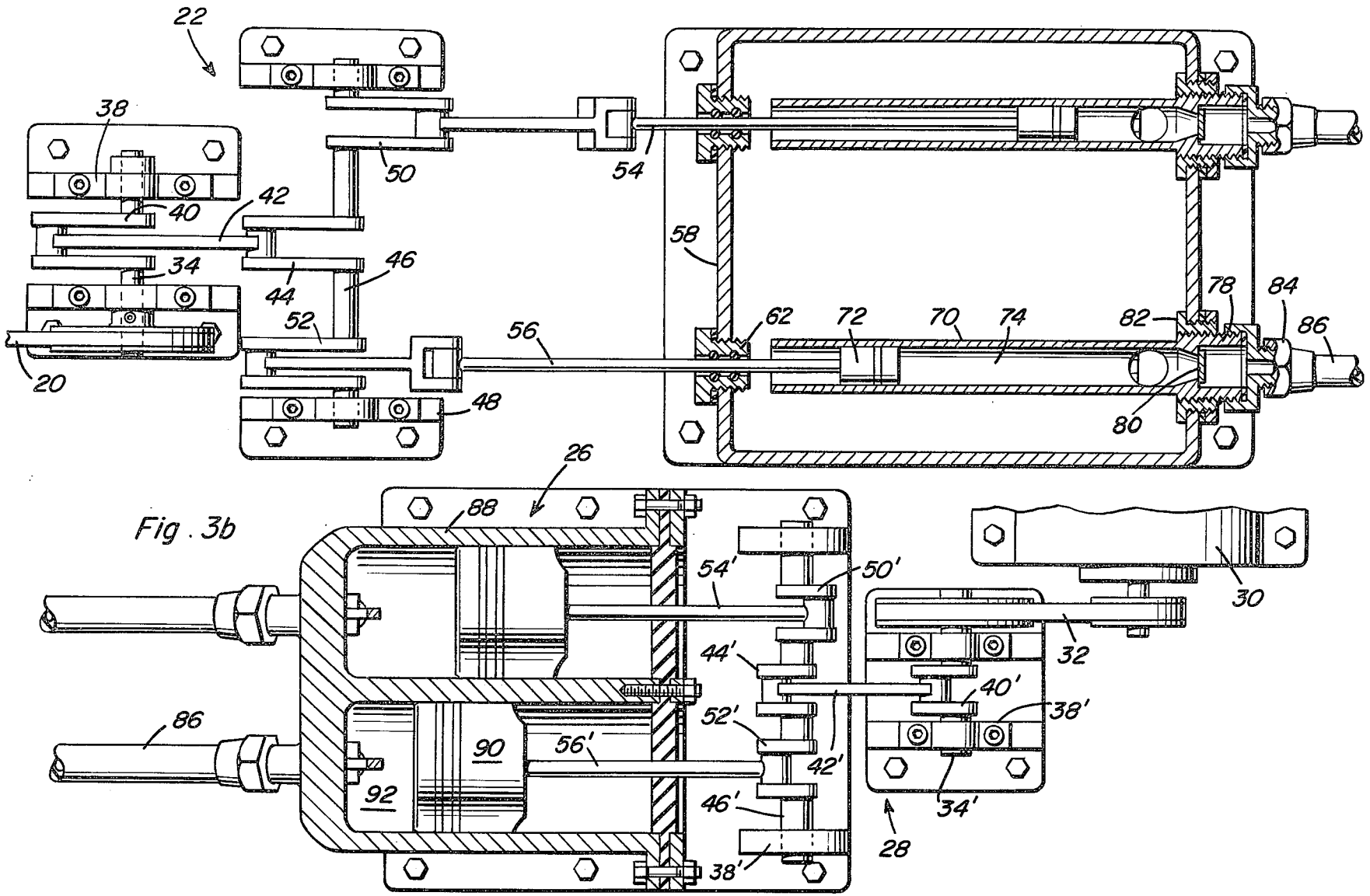

As more clearly seen in FIGS. 2*a* and 3*a*, the reciprocating drive assembly 22 includes an input crankshaft 34 to which the drive pulley 36 is connected at one axial end. The drive belt 20 is entrained about the drive pulley 36 and thereby imparts rotation to the crankshaft 34 rotatably supported by a pair of spaced bearing assemblies 38. Opposite end portions of the crankshaft 34 are interconnected by a crank 40 to which a connecting rod 42 is connected. The connecting rod interconnects the crank 40 with a crank 44 associated with a second crankshaft 46 rotatably mounted by spaced bearing assemblies 48 in parallel spaced relationship to the crankshaft 34. The crankshaft 46 also has associated therewith a pair of driven cranks 50 and 52 angularly spaced from each other by 180° on opposite axial sides of the drive crank 44. Each of the cranks 50 and 52 is pivotally connected to the ends of piston rods 54 and 56 that extend into the pump assembly 24.

Figure 2B:
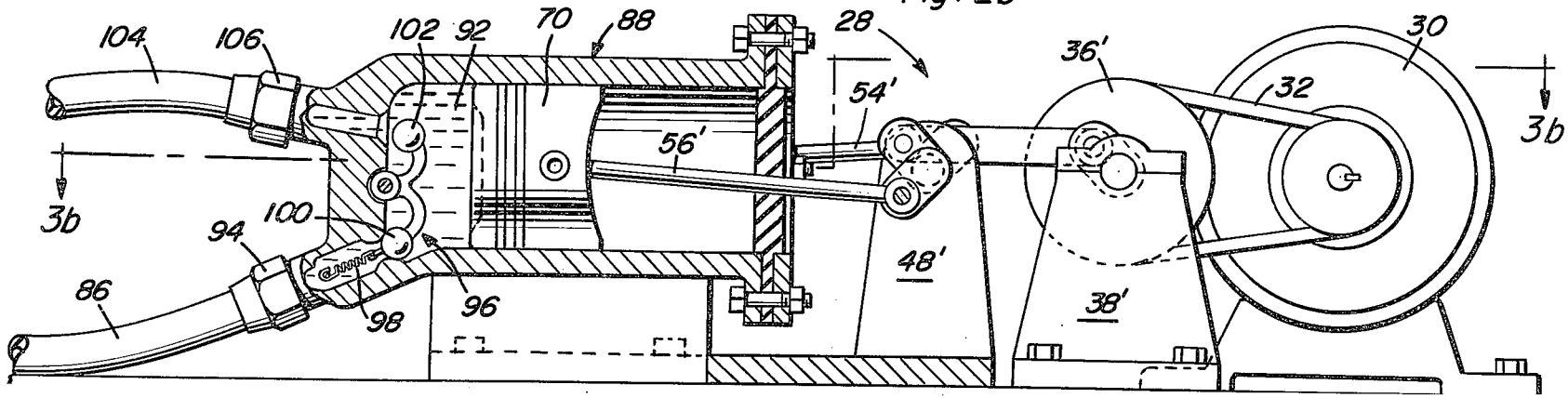

The driven reciprocating drive assembly 28 as more clearly seen in FIGS. 2*b* and 3*b*, is similar in arrangement to the reciprocating drive assembly 22 but dimensionally different. The reciprocating drive assembly 28 accordingly includes an output crankshaft 34' rotatably mounted by a pair of spaced bearing assemblies 38', the crankshaft 34' being connected to an output drive pulley 36' about which the drive belt 32 is entrained. A crank 40' interconnects the axial end portions of the crankshaft 34' between the bearing assemblies 38' and is interconnected by a connecting rod 42' with the crank 44' associated with crankshaft 46' rotatably mounted by spaced bearing assemblies 48' in parallel spaced relationship to the crankshaft 34'. Cranks 50' and 52' associated with crankshaft 46' in 180° angular relationship to each other, are pivotally interconnected with the ends of piston rods 54' and 56' extending from the motor assembly 26. As will be explained hereafter, the power and return strokes of the piston rods 54' and 56' while respectively in phase with the power and return strokes of the piston rods 54 and 56, are of a substantially shorter stroke length so as to transmit power at a torque multiplying ratio greater than one.

Referring now to FIG. 2*a* in particular, the pump assembly 24 includes a housing 58 completely filled with a fluid pressure medium such as hydraulic oil 60. Each of the piston rods extend into the housing 58 through a wiping seal assembly 62 in order to accommodate reciprocation of the piston rod with a minimum of fluid leakage. The top of the housing 58 is closed by a cover 64 secured to the housing by fasteners 66 with a sealing gasket 68 disposed therebetween to complete a pressure-tight enclosure for a plurality of horizontally elongated cylinders 70 associated with each of the piston rods. A single-acting piston 72 is slidably supported within each of the cylinders 70 so as to displace fluid through the cylinder during each power stroke. As illustrated in FIGS. 2*a* and 3*a*, the pistons 72 are displaced in a right-hand direction during the power stroke. Accordingly, the cylinders 70 are open at their left ends so as to form pressure chambers 74 on the right sides of the pistons that alternately undergo compression and expansion during reciprocation of the pistons.

An intake check valve 76 is mounted adjacent the right end of each of the cylinders 70 and is adapted to open in response to expansion of the pressure chamber 74 during the piston return stroke in order to admit an inflow of fluid 60 into the cylinder. The check valve 76 closes during the power stroke so that the fluid trapped in the pressure chamber 74 is pressurized and displaced from the outlet end portion 78 of the cylinder by opening of a one-way outlet check valve 80. The outlet end portion 78 is mounted in the wall of the housing 58 by a fitting 82 and is connected by a coupling 84 to a pressure conduit 86 associated with an open fluid circuit as will be explained hereafter. The pressure conduit 86 thus conducts fluid under pressure from each of the cylinders 70 associated with the pump assembly to an associated pressure cylinder chamber in the motor assembly 26.

Referring now to FIGS. 2*b* and 3*b*, the motor assembly 26 includes a cylinder housing generally referred to by reference numeral 88 forming cylinder chambers within which pistons 90 are slidably mounted and pivotally connected to associated piston rods 54' and 56'. The cylinder chambers on the right sides of the pistons 90 as viewed in FIGS. 2*b* and 3*b*, are vented to atmosphere whereas the cylinder chambers on the left sides of the pistons form fluid pressure spaces 92 that undergo expansion and contraction. Each of the pressure conduits 86 is connected to the cylinder housing 88 by a coupling 94 for fluid communication with an associated fluid pressure space 92 through a pressure-responsive valve assembly 96 that is biased to a closed position as viewed in FIG. 2*b* by a spring 98. In the embodiment illustrated in FIG. 2*b*, the valve assembly 96 includes a pair of valve elements 100 and 102 that are interconnected with each other and pivotally mounted by the cylinder housing 88 within the pressure space 92 so as to normally block inflow of fluid from the conduit 86. Fluid completely filling the conduit 86 will accordingly be trapped therein between the outlet check valve 80 in the pump assembly 24 and the valve element 100 of the pressure-responsive valve assembly 96 in the motor assembly 26. During the pressure stroke of the piston 72, fluid will be displaced through the conduit 86 causing the valve element 100 to be opened against the bias of its spring 98 to simultaneously displace the valve element 102 to the closed position blocking outflow from the pressure space 92. Accordingly, the pressure space 92 will be expanded to cause displacement of the piston 90 producing a corresponding pressure stroke movement that is imparted to the output reciprocating drive assembly 28. During the return stroke of the pump piston 72, the valve element 100 closes under the bias of spring 98 so as to open the valve element 102 permitting the outflow of fluid from the space 92 and its contraction. The outflowing fluid is accordingly conducted through an exhaust conduit 104 connected to the motor cylinder housing 88 by the coupling 106. The exhaust conduit 104 at its end opposite the motor assembly, connected by a coupling 108 to a reservoir tank 110 as more clearly seen in FIG. 2*a*. Fluid is stored within the reservoir tank 110 which communicates with the housing 58 through a connecting conduit 112 by means of which the reservoir tank 110 is secured to and mounted on the top cover 64 of the housing 58. The body of fluid stored in the reservoir tank 110 will therefore maintain the housing 58 completely filled with fluid. Further, after continued use of the power system, any loss of fluid due to leakage may be made up by filling the reservoir tank with additional fluid by opening of the filler cap 114.

Figure 4:
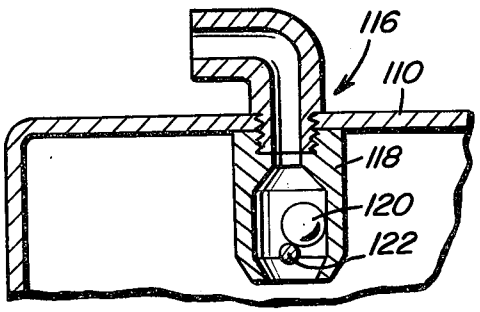
FIG. 4 is an enlarged partial sectional view taken substantially through a plane indicated by section line 4—4 in FIG. 1.

Vent valve assemblies 116 are mounted on the top of the reservoir tank 110 and cover 64 of the housing 58. The vent valves may be of a construction as shown in detail in FIG. 4 including a valve body 118 enclosing a valve ball element 120 retained in the valve body by a retainer rod 122. The valve element 120 is gravitationally biased to an open position as shown permitting the escape of any gas under pressure within the housing 58 or reservoir tank 110. When the enclosure is fully filled with liquid, the valve element 120 closes under the pressure of the liquid so as to prevent its escape from the enclosure. Thus, as long as liquid is stored within the reservoir tank 110, the liquid will completely fill the housing 58 to thereby assure that no gas or air is being displaced by the pistons 72. The liquid being relatively incompressible, as compared to gas, will produce a positive transmission of power at predetermined torque multiplying ratio.

Figure 5:
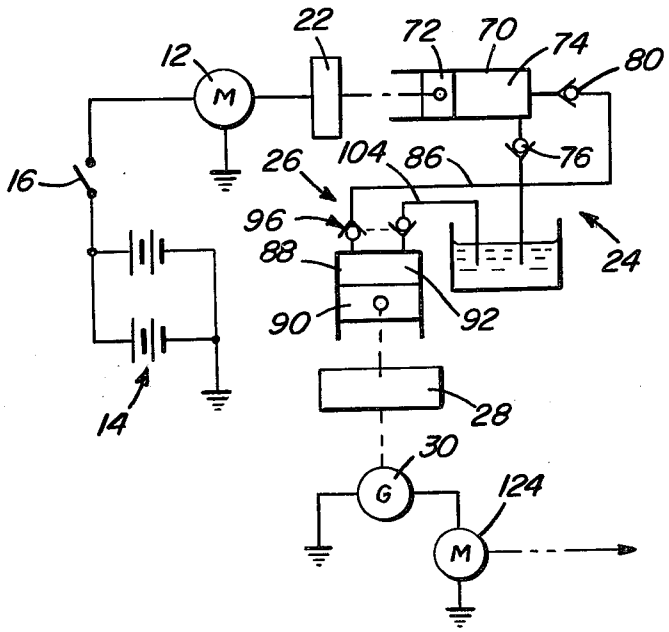
FIG. 5 is a schematic illustration depicting the power transmission system of the present invention corresponding to that shown in FIG. 1.

With reference to the diagrammatic illustration of FIG. 5, it will become apparent that despite the open fluid circuit within which the pump and motor assembies are arranged, the pressure spaces 74 and 92 associated with the single-acting pistons 72 and 90 will be maintained continuously filled with the relatively incompressible fluid by the action of the outlet check valve 80 and the pressure responsive valve assembly 96 in trapping fluid within the pressure conduit 86 and the continuous supply of fluid from the reservoir to the pump cylinder 70 through check valve 76. This arrangement also provides for convenient replacement of fluid lost by leakage without disturbing the operation of the power transmission system. The system as illustrated in FIG. 5 is suitable for transmitting power from a battery operated electric drive motor 12 to a generator 30 which may then transmit power, for example, to the wheels of a vehicle through a drive motor 124. It should however be appreciated that the power transmission system may be associated with other power sources and with other types of driven loads.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a torque multiplying power transmission, a piston pump assembly, a piston motor assembly, open circuit conduit means operatively interconnecting the pump and motor assemblies, reciprocating drive means connected to the pump and motor assemblies for respectively imparting and transmitting reciprocatory movement at a predetermined stroke ratio higher than one, a refillable reservoir connected to said open circuit conduit means and pressure responsive valve means connected to the motor assembly for maintaining the pump assembly continuously filled with fluid from the reservoir.

2. In a torque multiplying power transmission, a piston pump assembly, a piston motor assembly, open circuit conduit means operatively interconnecting the pump and motor assmblies. reciprocating drive means connected to the pump and motor assemblies for respectively imparting and transmitting reciprocatory movement at a predetermined stroke ratio higher than one, and refillable reservoir means connected to said open circuit conduit means for maintaining the pump assembly continuously filled with fluid, each of said pump and motor assemblies including a plurality of cylinders and single acting pistons slidable therein, and piston rods connecting the pistons to the reciprocating drive means, the pump assembly further including a pressure-tight housing enclosing the cylinders associated therewith and completely filled with fluid from the reservoir means, wiping seal means mounted on the housing through which the piston rods extend, an inlet check valve connected to each of the cylinders within the housing, and outlet valve means connecting each of the cylinders to the conduit means for pressurizing the same in response to displacement of an associated one of the pistons in one direction.

3. The combination of claim 2 wherein said conduit means includes a pressure line connecting each of the outlet valve means to the motor assembly and an associated exhaust line connecting the motor assembly to the reservoir means.

4. The combination of claim 3 wherein said motor assembly further includes pressure responsive valve means connected to each of the cylinders for alternately admitting inflow of fluid from the conduit means and outflow from the motor assembly to the reservoir means.

5. The combination of claim 4 wherein said pressure responsive valve means is connected to the pressure line for maintaining the same continuously filled with fluid while outflow of fluid is being conducted through the exhaust line.

6. In a torque multiplying power transmission, a piston pump assembly, a piston motor assembly, open circuit conduit means operatively interconnecting the pump and motor assemblies, reciprocating drive means connected to the pump and motor assemblies for respectively imparting and transmitting reciprocatory movement at a predetermined stroke ratio higher than one, and refillable reservoir means connected to said open circut conduit means for maintaining the pump assembly continuously filled with fluid, each of said pump and motor assemblies including a plurality of cylinders and single acting pistons slidable therein, and piston rods connecting the pistons to the reciprocating drive means, said motor assembly further including pressure responsive valve means connected to each of the cylinders for alternately admitting inflow of fluid from the conduit means and outflow from the motor assembly to the reservoir means.

7. The combination of claim 6 wherein said conduit means includes a pressure line connecting each of the cylinders in the pump assembly to the motor assembly and an associated exhaust line connecting the motor assembly to the reservoir means.

8. The combination of claim 7 wherein said pressure responsive valve means is connected to the pressure line for maintaining the same continuously filled with fluid while outflow of fluid is being conducted through the exhaust line.

9. In a torque multiplying power transmission, a piston pump assembly, a piston motor assembly, open circuit conduit means operatively interconnecting the pump and motor assemblies, reciprocating drive means connected to the pump and motor assemblies for respectively imparting and transmitting reciprocatory movement at a predetermined stroke ratio higher than one, each of said pump and motor assemblies including a plurality of cylinders and single acting pistons slidable therein, and piston rods connecting the pistons to the reciprocating drive means, and pressure responsive valve means connected to each of the cylinders for alternately admitting inflow of fluid from the conduit means and outflow from the motor assembly.

10. The combination of claim 1 wherein said pump assembly includes a pressure-tight housing completely filled with an incompressible fluid from the reservoir, and piston means connected to the drive means and mounted within the housing for displacement of fluid through the open circuit conduct means between the housing and the motor assembly.

11. The combination of claim 10 wherein said pump assembly further includes a valve body having a pressure chamber within which the piston means is displaceable, an inlet check valve mounted in the valve body through which fluid is conducted into the pressure chamber from the housing and an outlet check valve mounted in the valve body through which fluid is conducted from the pressure chamber to the open circuit conduit means.

12. The combination of claim 11 wherein said pressure responsive valve means includes a pair of interconnected valve elements alternatively blocking inflow of fluid to the motor assembly and outflow therefrom to the refillable reservoir through the open circuit conduit means.

13. The combination of claim 10 wherein said pressure responsive valve means includes a pair of interconnected valve elements alternatively blocking inflow of fluid to the motor assembly and outflow therefrom to the refillable reservoir through the open circuit conduit means.

14. The combination of claim 1 wherein said pressure responsive valve means includes a pair of interconnected valve elements alternatively blocking inflow of fluid to the motor assembly and outflow therefrom to the refillable reservoir through the open circuit conduit means.

* * * * *